United States Patent [19]

Schluter

[11] Patent Number: 4,829,731

[45] Date of Patent: May 16, 1989

[54] DEVICE FOR THE FORMATION OF A CONNECTING TRANSITION BETWEEN TWO PERPENDICULARLY ADJOINING SURFACES

[76] Inventor: Werner Schluter, Am Schierloh 6, 5860 Iserlohn, Fed. Rep. of Germany

[21] Appl. No.: 141,070

[22] Filed: Jan. 5, 1988

[30] Foreign Application Priority Data

Jan. 10, 1987 [DE] Fed. Rep. of Germany ..... 3700563

[51] Int. Cl.[4] ..... E04F 19/04

[52] U.S. Cl. ..... 52/287

[58] Field of Search ..... 52/35, 287, 288

[56] References Cited

U.S. PATENT DOCUMENTS

| | | | |
|---|---|---|---|
| 2,303,864 | 12/1942 | Reasor | 52/287 |
| 2,845,666 | 8/1958 | Knapp | 52/287 |
| 3,216,164 | 11/1965 | Stillman | 52/287 |
| 4,052,830 | 10/1977 | Smith | 52/288 |
| 4,204,376 | 5/1980 | Calvert | 52/287 |
| 4,411,112 | 10/1983 | Golden | 52/288 |
| 4,601,149 | 7/1986 | Dokan | 52/35 |
| 4,671,026 | 6/1987 | Wissinger | 52/35 |
| 4,730,432 | 3/1988 | Schafer | 52/288 |

FOREIGN PATENT DOCUMENTS

| | | | |
|---|---|---|---|
| 983809 | 2/1965 | United Kingdom | 52/288 |
| 2171734 | 9/1986 | United Kingdom | 52/287 |

*Primary Examiner*—John E. Murtagh

*Attorney, Agent, or Firm*—Collard, Roe & Galgano

[57] ABSTRACT

A device is disclosed for forming a connecting transition between two perpendicularly adjoining surfaces, of which at least one surface is provided with a rigid covering, in particular ceramic tile. The device allows for compensation of the varying stresses occurring in the surfaces bounding the joint combined with adequate sealing of the area of transition. The device is intended to find application in particular as a connecting transition between the edge of a bathtub and the adjoining wall and consists of a single-piece plastic angular profile. A sealing strip with a softened sealing lip is molded onto a leg of the angular profile which is formed of hardened material so as to extend the leg. The sealing lip has an adhesive profile arranged on its outer side in the lengthwise direction of the angular profile. By virtue of its elasticity, the molded sealing lip of the single-piece profile is biased against the surface to be sealed. Because the sealing lip is kept connected to such surface by an adhesive connection, it always acts against such surface in a sealing manner.

3 Claims, 2 Drawing Sheets

Figure 1:
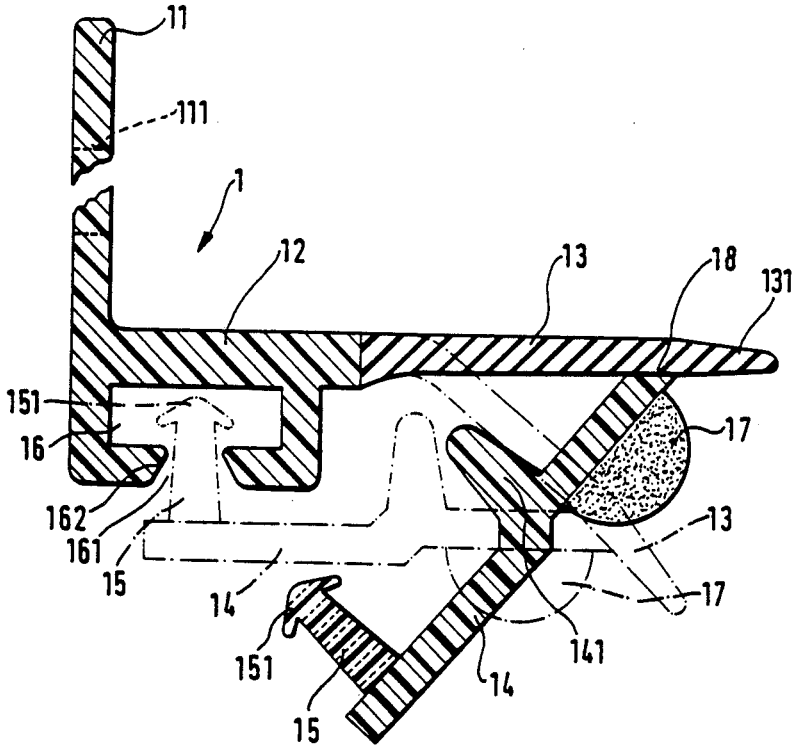

DEVICE FOR THE FORMATION OF A CONNECTING TRANSITION BETWEEN TWO PERPENDICULARLY ADJOINING SURFACES

The present invention relates to a device for forming a connecting transition between two perpendicularly adjoining surfaces, of which at least one surface is provided with a rigid covering such as ceramic tile. More particularly, the present invention relates to such a device having an angular profile and an outwardly acting, resilient sealing strip arranged on such profile.

A covering device for wall joints is known from published German patent application DE-OS No. 32 01 083, in particular for baseboard seams in bathrooms, steam rooms, etc., having an angular profile which, with one leg, can be secured on the surface bounding the wall joint while the other leg is loosely fitted in a recess on the other surface which has a matching depth. In this arrangement, a resilient sealing strip is fastened on the fastening leg, which covers the other leg and is biased against the other surface. For sealing the entire transition, provision is made for an additional sealing strip mounted on the secured lengthwise edge of the sealing strip. Such a covering device can be fitted only on the exterior of the adjoining surfaces forming the joint, so that the sealing strip, which is a kind of concave molding, is visible in its full and relatively large width. For the erection of such a covering device which seals adequately, three different profiles are required, which must be joined with one another.

In addition, a device of the type described above is also known from published German patent application DE-OS No. 35 03 396. The device according to this patent application is formed of two plastic angular profiles which are slidingly connected with each other. With such a profile connection, the fastening legs of the individual angular profiles are fastened or secured in an adhesive layer beneath the ceramic tiles. The sliding connection of the two angular profiles permits compensating stresses or expansions in the adjoining surfaces. However, such a device can be used only if both adjoining surfaces are provided with a rigid covering, so that the fastening legs of the individual angular profiles can be accommodated.

The object of the present invention is to provide a device for forming a connecting transition between two perpendicularly adjoining surfaces, wherein at least one surface has a rigid covering, in particular a ceramic tile covering, by which device the varying stresses occurring in the surfaces bounding the joint can be compensated for or accommodated while providing adequate sealing of the transition.

The above object is accomplished in accordance with the present invention by the provision of a device of the type described above, wherein a flexible sealing lip serving as the sealing strip is molded onto one leg of the angular plastic profile, the sealing lip forming an extension of such leg and having an adhesive profile arranged on its outer side in the lengthwise direction of the angular profile. Such a profile can be accommodated, for example within the zone or area of connection behind the ceramic tiles glued to the wall, without signficantly increasing the height of the adhesive layer. By virtue of the sealing lip molded onto the one leg, such a profile, because of its own elasticity, will be biased against the floor or, in a special application, against the edge of a bathtub. It has been found in practical application that floors with thermal and acoustic insulation will lower themselves with their insulation material inserts, in particular within the area of a bathtub, so that great variations in the width of the joint must be compensated for within the area of transition between the floor and the adjoining wall Such compensation is not possible, for example with permanent elastic fillings. In order to assure safe abstain of the sealing lip against the adjoining surface, for example the floor or the edge of a bathtub, an adhesive profile preferably of an elastic design is arranged on the outer facing side of the sealing lip or that side forming the outer side of the angular profile. In this way, the sealing lip is always forced into contact with the surface, sealing the latter, and the varying expansions or elongations are absorbed in the resilient sealing lip.

In order to facilitate the installation of a device according to the present invention, a fitting leg formed of hard plastic is molded onto the outer facing side of the sealing lip and the elastic adhesive profile is arranged on the outer facing side of this fitting leg. Preferably, a connecting bridge formed of a soft plastic material with a substantially T-shaped cross-section is molded onto the free end of the fitting leg and aligned with the leg having the sealing lip and detachably lockable with play in a groove-like undercut chamber on the leg with the sealing lip. In such a device, the fitting leg when locked into position extends parallel with the leg having the sealing lip. In this form, the device is inserted in the connecting transition of the adjoining surfaces and the adhesive profile is pressed against the one surface. If stress occurs in the tensile direction, the connecting bridge can detach itself with its head from the leg, so that the single-piece plastic profile is capable of absorbing substantial changes in the connecting joint. Of special advantage is the fact that such a device is a unitary structure or part, which can be installed in a simple manner and remains tight after the connecting transition has been formed.

Other objects and features of the present invention will become apparent from the following detailed description considered in connection with the accompanying drawings. It is to be understood, however, that the drawings are designed as an illustration only and not as a definition of the limits of the invention.

Figure 2:
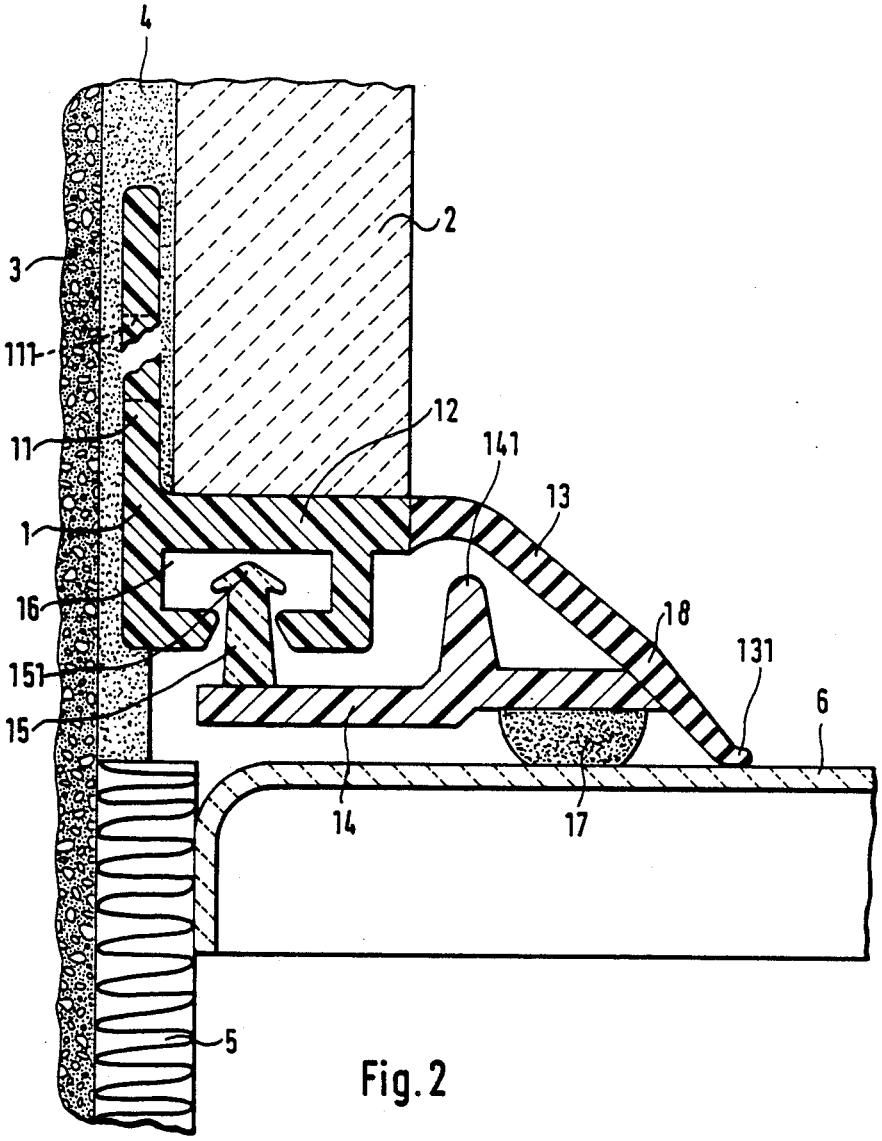

In the drawings, wherein similar reference characters denote similar elements throughout the several views:

FIG. 1 is an enlarged cross-sectional view of a single piece device for forming a connecting transition according to the present invention; and FIG. 2 is a cross-sectional view of the device according to the present invention forming the connecting transition from a tiled wall to the edge of a bathtub.

Now turning to the drawings, there is shown in FIG. 2 a plastic angular profile, generally designated 1, installed within the connecting transition between a wall 3 covered by ceramic tiles 2 and an edge 6 of a bathtub. Insulation board, designated 5, is installed between wall 3 and edge 6 of the tub.

Angular profile 1 is secured in an adhesive layer 4 behind ceramic tile 2 by means of its leg 11, which is provided with breakthroughs 111. The adjoining ceramic tiles 2 are seated on leg 12 of angular profile 1, which extends perpendicularly to leg 11. A relatively soft plastic sealing lip 13 is molded onto leg 12 to extend from the latter. Leg 12 is formed of hard plastic material. In its installed position sealing lip 13 is biased against edge 6 of the bathtub, sealing the latter with its end 131.

FIG. 1 shows that sealing lip 1,, during manufacture of the device, is molded onto leg 12 in a straight-line connection. A fitting leg 14, made of hardened plastic material, is molded onto sealing lip 13, about one-third the distance from its outer free end. In the present situation, fitting leg 14 is inclined toward the sealing lip. At its free end, fitting leg 14 has a connecting bridge 15 formed of softened, resilient plastic material having a head 151 with an approximately T-shaped cross section. With its head 151, connecting bridge 15 is detachably lockable in a chamber 16 formed on leg 12. This locked situation or position is shown in phantom in FIG. 1 and conforms to the installation situation shown in FIG. 2. In this disposition, fitting leg 14 is disposed approximately parallel with leg 12 of angular profile 1 and sealing lip 13 is bent downwardly and directed substantially outwardly. Head 151 of bridge 15 is tapered to thereby facilitate its insertion in insertion slot 161 which has facing flanks 162, which are inwardly inclined towards one another. In chamber 16, head 151 is detachably locked with play of motion.

On the outer facing side of fitting leg 14, an adhesive profile 17 is supported within the proximity to connection area 18 between sealing lip 13 and fitting leg 14. Such adhesive profile may be covered by a removable paper strip prior to use.

During installation, the fitting leg 14 is locked with its connecting bridge 15 on leg 12, and fitting leg 14 with adhesive strip 17, from which the paper strip, if any, has been removed, is pressed onto the edge 6 of the tub. To allow application of the required pressure, a supporting bridge 141 is molded onto fitting leg 14. Following this installation, the connecting transition to ceramic tiles 2 can be established, whereby leg 11 is accommodated in adhesive layer 4 behind ceramic tiles 2. If edge 6 of the tub is lowered, connecting bridge 15 detaches with its head 151 from chamber 66. However, the right connection between sealing lip 13 or its end 131 on tub edge 6 remains undisturbed.

In the same way, it is also possible to form a similar connection with a floor. Also, the reversed application or use of angular profile 1 is possible, i.e., leg 1 can be arranged under the ceramic tiles of a floor and sealing lip 13 acts against the adjoining wall.

While only a single embodiment of the present invention has been shown and described, it will be obvious that many changes and modifications may be made thereunto without departing from the spirit and scope of the invention.

What is claimed is:

1. A device for the formation of a connecting transition between two perpendicularly adjoining surfaces, wherein at least one surface is provided with a rigid covering, such as ceramic tile, said device consisting of an angularly shaped plastic profile which comprises:

a first leg;

a second leg angularly joined to said first leg;

an outwardly acting resiliently elastic sealing strip molded onto said first leg so as to extend the same;

a fitting leg formed of hard plastic material molded onto the side of said sealing strip facing away from said second leg;

an adhesive profile arranged on the side of said fitting leg facing away from said second leg and disposed in the longitudinal direction of the angular profile; and a support bridge molded onto said fitting leg and directed at said sealing strip.

2. The device as defined in claim 1, which further comprises a connecting bridge formed of soft plastic material molded onto the free end of said fitting leg, said connecting bridge having an approximately T-shaped cross section and being aligned with said first leg having said sealing strip, and detachably lockable with play in a groove-like, undercut chamber arranged on said first leg.

3. The device as defined in claim 2, wherein said connecting bridge is provided with a head which is tapered, and said undercut chamber defines an insertion slot into the chamber having face flanks inwardly inclined towards one another.

* * * * *